US006593538B2

(12) United States Patent
Perret et al.

(10) Patent No.: US 6,593,538 B2
(45) Date of Patent: Jul. 15, 2003

(54) HIGH-VOLTAGE INTERRUPTER DEVICE HAVING COMBINED VACUUM AND GAS INTERRUPTION

(75) Inventors: Michel Perret, Bourgoin Jallieu (FR); Denis Dufournet, Sathonay Camp (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/175,953

(22) Filed: Jun. 21, 2002

(65) Prior Publication Data

US 2002/0195425 A1 Dec. 26, 2002

(30) Foreign Application Priority Data

Jun. 25, 2001 (FR) ..... 01 08319

(51) Int. Cl.[7] ..... H01H 33/14
(52) U.S. Cl. ..... 218/3; 218/7
(58) Field of Search ..... 218/3, 6, 7, 14, 218/154, 16, 78, 70, 143

(56) References Cited

U.S. PATENT DOCUMENTS 3,038,980 A 6/1962 Lee ..... 218/126
4,087,664 A 5/1978 Weston ..... 218/3
4,434,332 A 2/1984 Yanabu et al. ..... 218/144
5,170,023 A * 12/1992 Pham et al. ..... 218/143
5,905,242 A * 5/1999 Bernard et al. ..... 218/16

FOREIGN PATENT DOCUMENTS

EP 0 737 993 A1 10/1996
WO WO 97/08723 3/1997

* cited by examiner

*Primary Examiner*—Elvin Enad
*Assistant Examiner*—M. Fishman
(74) *Attorney, Agent, or Firm*—Sughrue Mion, PLLC

(57) ABSTRACT

A hybrid interrupter device includes a casing filled with a dielectric gas; a vacuum interrupter having a first arcing contact which is fixed and a second arcing contact which moves in translation in the axial direction of the casing; a force exertion device for exerting a force on the second contact while the vacuum interrupter is allowing current to pass; a gas interrupter having a third arcing contact which is fixed and a fourth arcing contact which moves in translation; and a drive rod connected to the fourth contact. The device further includes a connection device electrically interconnecting the second and third contacts, and capable of being moved in translation together with the second contact; and a displacement mechanism connected to the connection device and to the rod for displacing them so as to separate the second and fourth contacts from the first and third contacts, respectively.

22 Claims, 9 Drawing Sheets

HIGH-VOLTAGE INTERRUPTER DEVICE HAVING COMBINED VACUUM AND GAS INTERRUPTION

The invention relates to an interrupter device of the hybrid type for high or medium voltage. The term "hybrid" applies to interruption which is of the combined type in which two different interruption techniques are caused to co-operate. The term "hybrid" is used in particular to designate an interrupter device that comprises both a vacuum interrupter containing a first pair of arcing contacts, and also a gas interrupter containing a second pair of arcing contacts.

BACKGROUND OF THE INVENTION

A device of this type is known from U.S. Pat. No. 3,038,980. It comprises a casing filled with a dielectric gas and having a longitudinal axis. The two interrupters are connected electrically in series and are disposed inside the casing, while the control mechanism for controlling the device is disposed outside the casing. The mechanism for actuating the contacts of the two interrupters is relatively simple in that one of the two contacts of the gas interrupter is secured to a moving contact which is adjacent to it in the vacuum interrupter. The other contact of the gas interrupter is secured to a drive rod connected to the control mechanism for controlling the device. A mechanism having a spring associated with an abutment maintains the contacts of the gas interrupter one against the other during a first portion of their stroke while the device is opening, until the contacts of the vacuum interrupter have separated by a determined distance. The object of such a sequence for separating the contacts of the two pairs is to make it possible to delay the separation of the contacts of the second pair (gas interrupter) relative to the separation of the contacts of the first pair (vacuum interrupter).

Unfortunately, such a sequence is not satisfactory if the high-voltage hybrid device associates a gas interrupter designed for a standardized high voltage higher than 72.5 kV with a vacuum interrupter designed for a standardized medium voltage lower than 52 kV. So long as the contacts of the gas interrupter have not separated while the device is interrupting a fault current, the vacuum interrupter is subjected to the entire transient recovery voltage across the terminals of the interrupter device while its contacts are separating. Unfortunately, the vacuum interrupter is designed to withstand only a recovered voltage that remains within medium voltage limits. Thus, a high-voltage hybrid interrupter device that implements the above-described sequence for separating contacts can interrupt the current only after the two contacts of the gas interrupter have separated. Such operation involves an arcing time that is relatively long, and that is longer than the time a vacuum interrupter is designed to withstand. The general structure of the device described in that U.S. Pat. No. 3,038,980 does not make it possible to modify the sequence for separating the contacts. In particular, it is not possible with such a device to obtain simultaneous or delayed separation of the contacts of the vacuum interrupter relative to the separation of the contacts of the gas interrupter.

Another device of that type is known from patent application EP 1 109 187, which enables the sequence for separating the contacts to be adjusted so as to be able to obtain simultaneous or slightly delayed separation of the contacts of the vacuum interrupter relative to the separation of the contacts of the gas interrupter. The moving contact of the vacuum interrupter is connected to a connecting rod having one end that rotates, the end or head of the connecting rod being hinged on a crank pin of a flywheel that can be coupled to or uncoupled from a toothed rod controlled in translation by the drive rod of the gas interrupter.

However, that device presents certain drawbacks from a mechanical point of view. Firstly, it is necessary to exert sufficient force on the moving contact of the vacuum interrupter so long as current is able to pass therethrough, so as to ensure mutual pressure between the contacting surfaces of the contacts of the interrupter which is greater than a given value in order to overcome the electrodynamic forces generated by the passing current. The flywheel of the device must therefore be provided with a resilient return system which enables the required force to be exerted on the moving contact of the vacuum interrupter. Secondly, the motion of the drive rod of the gas interrupter is transmitted towards the vacuum interrupter by a connecting rod having an axis that is oblique relative to the axis of translation of the moving contact of the vacuum interrupter. That results in significant transverse stresses on the vacuum interrupter, thereby limiting its mechanical endurance.

Finally, another device of this type exists which is described in patent application EP 1 117 114, and which compared to the previous device has, in particular, the advantage that the moving contact of the vacuum interrupter is always subjected to forces that are directed only along the longitudinal axis of the interrupter. In addition, resilient spring means are provided to maintain a mutual pressure between the contacts of the vacuum interrupter while the interrupter is closed. However, in that device, the separating movement of the contacts of the vacuum interrupter is under the control of the drive rod of the gas interrupter, so the contacts of the vacuum interrupter can be separated only once the contacts of the gas interrupter have been opened. It is necessary for that device to have such a sequence of deferred separation of the contacts so as to cause the current to pass through zero before the vacuum interrupter ensures interruption on its own. The device is used exclusively as a generator circuit-breaker, and consequently, the gas interrupter is present only to reduce the unbalanced fraction of the current.

Obviously, with that device, it is not possible to produce simultaneous or slightly delayed separation of the contacts of the vacuum interrupter relative to the separation of the contacts of the gas interrupter.

OBJECTS AND SUMMARY OF THE INVENTION

An object of the invention is to remedy the drawbacks or limitations of the prior art, by providing a hybrid interrupter device for high or medium voltage that is relatively compact and longlasting, and that when operating with a single drive member, i.e. with a control mechanism connected to a single drive rod, enables the interrupter contact separation sequence to be adjusted.

To this end, the invention provides a hybrid-type interrupter device for high or medium voltage, the device comprising:

- a casing filled with a dielectric gas and having a longitudinal axis;
- a vacuum interrupter disposed inside the casing, and having a first pair of arcing contacts constituted by a first contact which is fixed and by a second contact which can be moved in translation in the longitudinal direction of the casing;

means provided to exert a force on the second contact such that the mutual pressure between the contacting surfaces of the first and second contacts is greater than a determined value while the vacuum interrupter is allowing current to pass;

a gas interrupter disposed inside the casing, and having a second pair of arcing contacts constituted by a third contact which is fixed and by a fourth contact which can be moved in translation in the longitudinal axial direction, and also having a blast chamber which comprises a thermal blast volume; and a drive rod connected to the fourth contact and that can be held stationary or moved in translation by control means;

the device further comprising;

connection means electrically interconnecting the second and third contacts, and capable of being moved in translation in the longitudinal axial direction together with the second contact;

displacement means connected to the connection means and to the drive rod for displacing them so as to separate the second and fourth contacts from the first and third contacts respectively, said displacement means comprising dead-stroke link means connecting the connection means to the rod, the link means making it possible to displace the rod over a determined dead stroke while also acting on the connection means to keep the vacuum interrupter closed during this displacement.

Advantageously, for applications where a device of the invention is intended to be used as a circuit-breaker in a high-voltage network, the displacement means are organized so that the separations of the contacts both of the vacuum interrupter and of the gas interrupter take place simultaneously or with a small offset in time. This enables the transient recovery voltage which appears between the contacts of each interrupter as soon as they separate to be shared appropriately between the vacuum interrupter and the gas interrupter.

For applications where a device of the invention is intended to be used as a generator circuit-breaker for a medium-voltage network, the displacement means are preferably organized so that the separation of the contacts of the vacuum interrupter is substantially delayed relative to the separation of the arcing contacts of the gas interrupter, so that the gas interrupter causes the current to pass through zero before the vacuum interrupter interrupts the current.

In particular embodiments implementing said dead-stroke link means, an interrupter device of the invention may comprises one or more of the following characteristics taken in isolation or in any technically feasible combination:

the dead-stroke link means comprise return-movement means which co-operate with first resilient means connected to the connection means or to the drive rod;

the displacement means comprise second resilient means suitable for co-operating with the connection means for separating the contacts of the vacuum interrupter as soon as the drive rod has traveled over said dead stroke, and suitable for displacing the connection means and the second contact over a determined isolation stroke relative to the first contact while the device interrupts current, the isolation stroke corresponding to the complete separation distance of the contacts of the vacuum interrupter;

the first and second resilient means respectively comprise a first and a second spring each compressed and suitable for extending with a determined extension, said springs co-operating respectively with first and second abutment means each suitable for interrupting the relaxation of the spring with which it co-operates, each spring exerting thrust on the connection means along the axis, and the two springs exerting thrust in opposite directions;

said first abutment means are secured to the connection means;

said second abutment means are connected to the third contact, and provide the electrical connection with the connection means;

said return means comprise two portions suitable for being displaced together in mutual abutment, and suitable for being dissociated during opening of the vacuum interrupter; and a first portion of said return means is subjected to a thrust from the first resilient means which makes it possible to displace said portion over said dead stroke relative to the connection means, a second portion of said return means being constrained to move in translation with the rod.

In a first embodiment of an interrupter device of the invention, the contacts of the gas interrupter are interfitted one in the other when in the closed position, with an overlap distance that is less than or equal to the dead stroke that can be traveled by the first portion of the return means along the connection means.

In a second embodiment, of an interrupter device of the invention, the contacts of the gas interrupter are in mutual abutment in the closed position, and delay means for delaying the start of movement of the fourth contact are interposed between said fourth contact and the drive rod for actuating the device. In a variant of this second embodiment, the drive rod and the third and fourth contacts are tubular in shape along the axis, and said delay means comprise:

a first tubular element that is disposed in axial alignment with the fourth contact, that is secured thereto, and that can slide inside the rod while said rod is being displaced, the sliding distance being less than or equal to said determined dead stroke;

third abutment means fixed to an end of the first tubular element where it is connected to the fourth contact;

a second tubular element that is secured via one end to the second portion of the return means, that is of diameter greater than the diameter of the first tubular element, that can slide along the third abutment means along the axis while the rod is being displaced, and that is provided at its other end with an annular cap serving to come into abutment with said abutment means; and a helical third spring disposed along the axis, interposed between the first tubular element and the second tubular element, in abutment at one end against the third abutment means and at the other end against the second portion of the return means.

Each of the third and fourth tubular contacts may have its end provided with an end-piece made of a refractory conductive material.

For the two above-mentioned embodiments, an interrupter device of the invention may comprise one or more of the following characteristics taken in isolation or in any technically feasible combination;

the connection means are constituted by a metal socket that is circularly symmetrical about the axis, said socket having a hollow tubular portion which, at its open end, has a first annular shoulder that constitutes the first abutment means;

the metal socket has a cylindrical portion in which an annular recess is provided that is open facing towards the vacuum interrupter and that serves to receive the second spring, the wall that surrounds said annular recess optionally having, at its end, a second annular shoulder for holding the first spring in abutment;

in order to enable the return means to be moved in translation along the connection means, the first portion of the return means has, at one end, an annular wall which comes into abutment against an end of the first spring, the inside diameter of said annular wall being equal to the outside diameter of the tubular portion of the socket;

the second abutment means are constituted by a cylindrical stud fixed to the third contact and disposed in axial alignment therewith, the metal socket being engaged over said stud and being mounted to slide therein while also providing permanent electrical contact therewith, the hollow tubular portion of said socket having an end-wall serving to come into abutment against said second abutment means;

the magnitudes of the thrusts of the first and second springs are organized to have, at all times, a difference in favor of the magnitude of the first spring, this difference remaining continuously greater than a determined threshold;

the second of the two portions of the return means is electrically connected permanently to a terminal and supports a sliding contact serving to be in electrical contact with a conduction element when the interrupter device is closed;

said conduction element is fixed to the connections so as to be electrically connected permanently to the second contact of the vacuum interrupter;

a varistor is electrically connected in parallel with the contacts of the vacuum interrupter in order to make it possible to limit the voltage applied to said vacuum interrupter, so as to distribute appropriately the voltages applied to the vacuum interrupter and to the gas interrupter during opening of the interrupter device; and a capacitor is mounted in parallel with one of the interrupters or in parallel with each of the interrupters for the purpose of obtaining said appropriate distribution.

BRIEF DESCRIPTION OF THE DRAWINGS

The invention, its characteristics, and its advantages are described in more detail in the following description given with reference to the following figures.

MORE DETAILED DESCRIPTION

Figure 1:
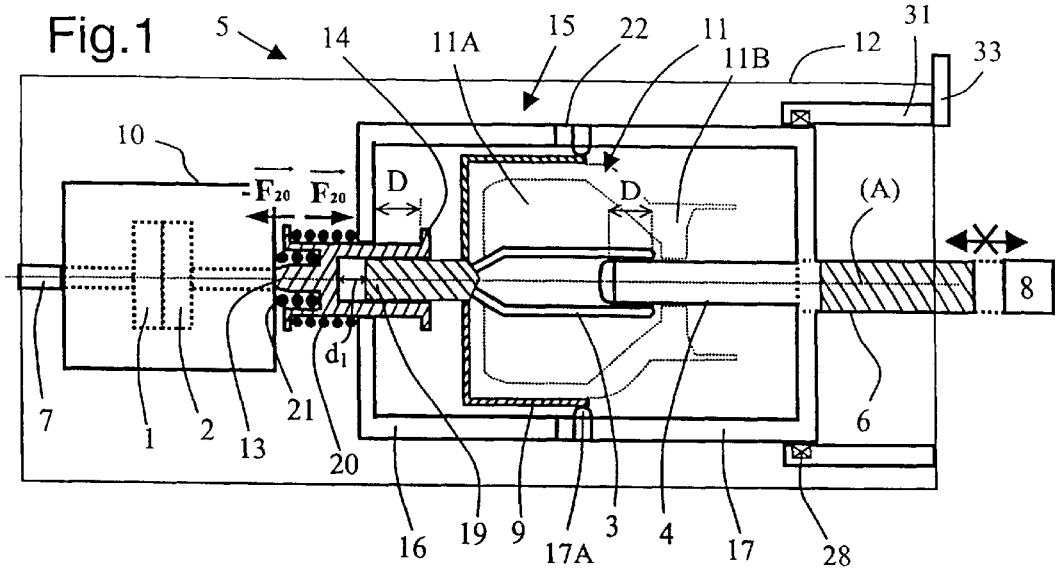
FIG. 1 is a simplified diagram showing the principle of and the main elements of a high-voltage hybrid interrupter device of the invention in a particular embodiment, shown in the closed position.

The high-voltage hybrid interrupter device 5 shown in FIG. 1 is substantially circularly symmetrical about an axis A. It includes a vacuum interrupter 10 enclosing a first pair of arcing contacts 1 and 2. A first contact 1 is fixed and is connected permanently to an end feedthrough 7 of the device 5. A second contact 2 is mounted to move along the axis A. The device also includes a gas interrupter 11 that is electrically connected in series with the vacuum interrupter. The gas interrupter contains a second pair of arcing contacts, constituted by a third contact 3 and by a fourth contact 4. The third contact 3 is fixed in the casing 12 by means of holding means shown in FIGS. 8 and 9. The fourth contact 4 is mounted to move along the axis A and is secured to a drive rod 6 that is connected to the control mechanism 8 for controlling the device 5. The two interrupters 10 and 11 are disposed in a common casing filled with a dielectric gas.

In the embodiment shown, the moving contact 4 is inserted in the fixed contact 3 over a certain overlap distance when the interrupter device is closed. By means of this overlap, the separation of the third and fourth contacts take place at an instant when the drive rod 6 has traveled along a determined "speed-gathering" distance, i.e. the overlap distance corresponds to the speed-gathering distance traveled by the rod 6. The gathered speed is applied to the moving contact 4 of the gas interrupter and makes it possible for the contact 4 to be separated from the fixed contact 3 at a relatively high speed as soon as they begin to be separated. A few milliseconds after said separation, said speed can reach a value high enough to facilitate extinguishing the electric arc that strikes between the contacts of the interrupter. It is particularly useful for interrupting "capacitive" currents without the electric arc re-striking.

The contact 2 is constrained to move in translation with moving connection means 13 which electrically connect it permanently to the fixed contact 3. Since the third contact is organized to remain fixed in the interrupter device, the separation of the contacts 3 and 4 in the gas interrupter does not depend on the mechanical operation of the assembly carrying the second moving contact of the vacuum interrupter.

Return means 15 are dissociable in two portions 16 and 17. The two portions abut against each other along the axis A via coupling means 22 provided at their facing ends. The second portion 17 is constrained to move in translation with the rod 6, and the first portion 16 may be displaced in translation over a determined dead stroke D along the axis A relative to the connection means 13. In the embodiment shown, the stroke D is equal to the overlap distance over which the contacts 3 and 4 overlap, i.e. said stroke is equal to the above-defined speed-gathering distance.

The return means 15 may also be embodied by a telescopic link (not shown) comprising two portions that can be locked in abutment against each other, and that slide one in the other as they move apart axially, such a telescopic link being functionally equivalent to the means 15 shown diagrammatically in FIG. 1. However, such an embodiment can suffer from drawbacks due to the increase in the moving masses.

First resilient means are provided to keep the vacuum interrupter closed, by exerting a first thrust on the connection means 13 and thus on the contact 2, which first thrust remains higher than a determined threshold until an instant when the rod 6 has traveled along the dead stroke D.

Figure 2:
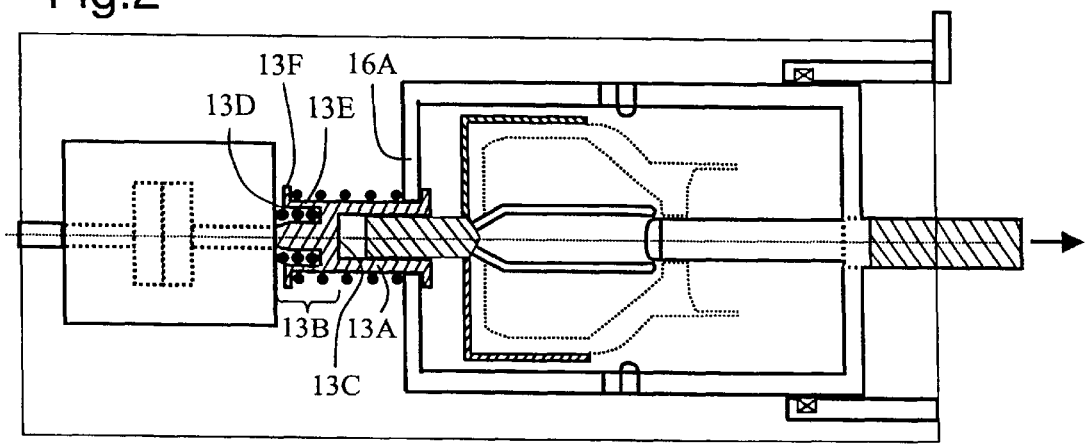
FIGS. 2 and 3 show successive steps of opening of the hybrid interrupter device shown in FIG. 1.

At this instant, corresponding to the diagram in FIG. 2, the contacts of the gas interrupter separate. This first thrust ceases to act on the connection means at said instant, so as to allow second resilient means to act on the contact 2 by exerting a second thrust in the opposite direction. The second thrust starts the contact 2 moving, thereby causing the contacts of the vacuum interrupter to separate. This separation takes place simultaneously or with a delay relative to the separation of the contacts of the gas interrupter, and in a determined sequence.

In the device described, the first and second resilient means provided for exerting said first and second thrusts comprise respectively a first spring 20 and a second spring 21, both of which are loaded in compression. The springs are associated respectively with first and second abutment means 14 and 19. The first spring 20 is mounted between the connection means 13 and the first portion 16 so as to exert opposite thrusts $-\overline{F}_{20}$ and $\overline{F}_{20}$ respectively on these elements. The closed position of the interrupter device 5 is maintained by the rod 6 being locked so that it cannot move by the control mechanism 8, thereby making it possible to hold the two portions 16 and 17 stationary in abutment one against the other, and also to maintain a certain pressure on the contacts 1 and 2 by means of the first spring 20 associated with the connection means 13. This contact pressure makes it possible for the interrupter to pass a fault current, and it depends on the value of the fault current to be withstood.

When a current interruption command is sent to the control mechanism 8 of the interrupter device 5, the rod 6 must be unlocked to allow the first portion 16 to move in translation relative to the means 13 under the effect of the first spring 20 relaxing. This relative movement is then stopped as soon as the first portion 16 has traveled over the dead stroke D by the first abutment means 14 that are provided on the connection means 13, so that said portion 16 is constrained to move in translation with said means 13, as shown in FIG. 2.

The return means 15 and the first resilient means (20, 14) form a link assembly that connects the connection means 13 to the rod 6. This assembly is referred to as "dead-stroke" link means in that they make it possible for the connection means to move with the rod so long as the rod has not traveled over the determined dead stroke. During said dead stroke D, the connection means 13 remain stationary since the return means 15 do not transmit the movement of the rod 6 to it. This property applies both on opening and on closure of the interrupter device.

During the separation of the contacts 1 and 2 of the vacuum interrupter 10, the contact 2 is moved by the semi-moving second spring 21, one end of which is stationary since it abuts permanently against that face of the vacuum interrupter through which the rod carrying the contact 2 passes. The other end of said spring 21 is a moving end that abuts permanently against the connection means 13, and that exerts a thrust thereagainst that remains considerably lower than the thrust exerted by the first spring 20.

The dead-stroke link means co-operates with the second resilient means to move the rod 6 and the connection means 13 so as to separate the moving contacts 2 and 4 from their respective fixed contacts 1 and 3. In the embodiment shown, said link means are a component part of the displacement means that make it possible for the separations of the contacts 1 and 2 and of the contacts 3 and 4 respectively of the vacuum interrupter and of the gas interrupter to take place simultaneously or with a small offset in time.

Figure 3:
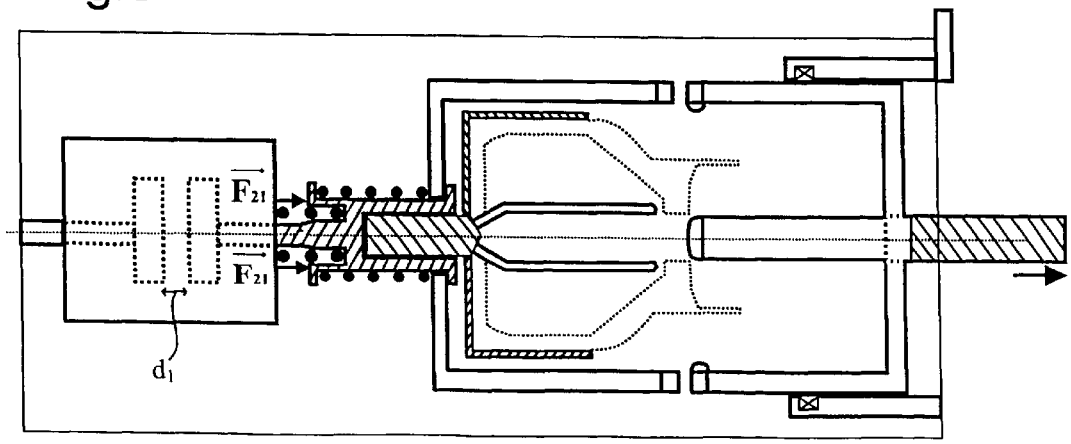

The second abutment means 19 are disposed so as to stop the movement in translation of the connection means 13 as soon as said connection means have traveled over a certain isolation stroke $d_1$, as shown in FIG. 3. These abutment means 19 are electrically and mechanically connected to the fixed contact 3, and they advantageously participate in the electrical link between the contacts 2 and 3. In this example, they are constituted by a cylindrical stud of axis A that is inserted in a hollow tubular portion of the moving connection means 13, which portion can thus slide along the axis A. They are further electrically and mechanically connected to a conduction element 9 that surrounds and holds a blast chamber disposed along the axis A. In known manner, said chamber comprises a thermal blast volume 11A and a blast nozzle 11B.

The conduction element 9 acts as the main contact for passing the permanent current when the interrupter device 5 is closed. The electrical link between the element 9 and a terminal 33 is provided via a sliding contact 17A supported by the second portion 17 of the return means 15 at the coupling means 22. This second portion 17 is electrically conductive and it moves in translation with the rod 6 while remaining in electrical contact via a sliding contact 28 with a fixed conductive tube 31 connected to the terminal 33. The first portion 16 of the return means 15 is electrically insulating for reasons explained below.

The connection means 13 in the embodiment shown are constituted by a metal socket that is circularly symmetrical about the axis A. The various portions making up this part are referenced in FIG. 2. The socket has a hollow tubular portion 13A which, at its open end, has a first annular shoulder that constitutes the first abutment means 14. The hollow portion 13A has an end wall 13C serving to come into abutment against the cylindrical stud that constitutes the second abutment means 19. The socket also includes a cylindrical portion 13B in which an annular recess 13D is provided that is open facing towards the vacuum interrupter 10 and that serves to receive the second spring 21. At its end, the wall 13E that surrounds the recess 13D is provided with a second annular shoulder 13F for holding the first spring 20 in abutment. The spring 20 is compressed permanently between said shoulder 13F and an annular wall 16A provided at one end of the first portion 16. The inside diameter of said wall 16A is equal to the outside diameter of the tubular portion 13A of the socket 13, so that the portion 16 can slide along the socket along the axis A.

After the rod 6 is unlocked, the first portion 16 of the return means 15 moves in translation from the position shown in FIG. 1 to the position shown in FIG. 2. In moving, it pushes the second portion 17, and the sliding contact 17A is organized to separate from the conduction element 9 so that the fault current passes exclusively via the arcing contacts 3 and 4 in the gas interrupter 11, As mentioned above, the first portion 16 is electrically insulating or at least it makes it possible to insulate the connection means 13 electrically from the second portion 17 which is conductive. If said portion 16 were entirely conductive, electric arcs would strike between the portions 16 and 17 after the sliding contact 17A has been disconnected from the conduction element 9.

The movement in translation of the return means 15 is transmitted to the rod 6, and therefore to the moving contact 4 of the gas interrupter. The thrust delivered by the first spring 20 relaxing makes it possible to assist the control mechanism 8 in driving the rod.

In FIG. 2, the device is shown at the moment when the annular wall 16A of the first portion 16 comes into abutment against the first abutment means 14, after it has traveled over the distance D. Simultaneously, the moving contact 4 has traveled over the same distance D in the gas interrupter, and it is about to be separated from the fixed contact 3. At this stage, the thrust $-\overline{F}_{20}$ of the first spring 20 can no longer act effectively on the connection means 13 to maintain the pressure on the contact 2, and the thrust of the second spring 21 is free to act on said means 13 to move them in translation. The moving contact 2 in the vacuum interrupter 10 is then about to be separated from the fixed contact 1, simultaneously with the separation of the contacts 3 and 4 in the gas interrupter.

Between the positions shown in FIGS. 2 and 3, the connection means 13 are caused to start to move by the second spring 21 relaxing, which spring permanently exerts a thrust $\overline{F}_{21}$ on said means 13 as shown in FIG. 3. The connection means starting to move in this way causes firstly the second contact 2 to move so as to open the vacuum interrupter 10, and secondly the return means 15 to continue to move in translation.

As shown in FIG. 3, provision is made for the contact 2 to stop moving as soon said contact is completely separated from the contact 1 in the vacuum interrupter 10. Complete separation is achieved when the moving contact 2 is separated from the fixed contact 1 by a determined isolation distance in a vacuum, e.g. about 15 millimeters (mm). To this end, the movement of the connection means 13 is stopped by the second abutment means 19 which are disposed so that the stroke $d_1$ traveled by said means 13 is equal to the isolation distance corresponding to complete separation of the contacts 1 and 2.

The thrust $\overline{F}_{21}$ of the second spring 21 is organized to be sufficient, in a first stage, to deliver the energy necessary to move the contact 2 and the parts 13 and 16 that are constrained to move in translation therewith, and, in a second stage, to keep the contacts 1 and 2 open as shown in FIG. 3. However, this thrust remains very considerably lower in magnitude than the thrust $F_{20}$ of the first spring 20. So long as the vacuum interrupter 10 remains closed, as shown in FIGS. 1 and 2, the pressure to be maintained on the contacts 1 and 2 is quite high, e.g. about 2,000 newtons (N) for a fault current of 40 kiloamps (kA). The thrusts $F_{20}$ and $F_{21}$ of the first and second springs are thus organized to have a difference $\Delta F$ defined as $F_{20}-F_{21}$ that remains higher than a determined threshold S. $F_{20}$ decreases between the instants corresponding to FIGS. 1 and 2, while $F_{21}$ is stable at its maximum, $F_{20}$ remaining high enough to satisfy the condition $F_{20}>F_{21}+S$.

In a particular configuration of the control mechanism 8 for controlling the rod 6 that actuates opening of the interrupters, said rod is driven in translation by the mechanism 8 at a speed higher than the speed acquired by the connection means 13 under the effect of the second spring 21 relaxing. The device shown in FIGS. 1 to 4 operates using this configuration. In this case, the portions 16 and 17 of the return means 15 are organized to separate before the means 13 come into abutment, i.e. before the contacts 1 and 2 are completely separated at the instant corresponding to FIG. 3. For example, the separation of the portions 16 and 17 may be organized to start just after the separation of the contacts 1 and 2, i.e. just after the instant corresponding to FIG. 2. Thus, only a first stage of the movement in translation of the contact 2 is transmitted to the rod 6 by the return means 15. After said first stage, which can be very short, the return means 15 thus no longer exert any action on the rod 6 to assist it in moving in translation, its movement in translation then being caused entirely by the control mechanism 8. This operating mode makes it possible for the moving contact to have a higher speed at the moment at which the arc between the contacts 3 and 4 in the gas interrupter 11 is blasted.

The contacts 1 and 2 are kept open in the vacuum interrupter 10, until the contacts 3 and 4 in the gas interrupter are completely open, in which the contacts are separated by a certain isolation distance in the gas at the end of the stroke of the moving contact 4. This isolation distance in the gas is much longer than the distance $d_1$ mentioned for the vacuum interrupter, since it generally lies in the range 80 mm to 200 mm for most gas blast interrupters.

Figure 4:
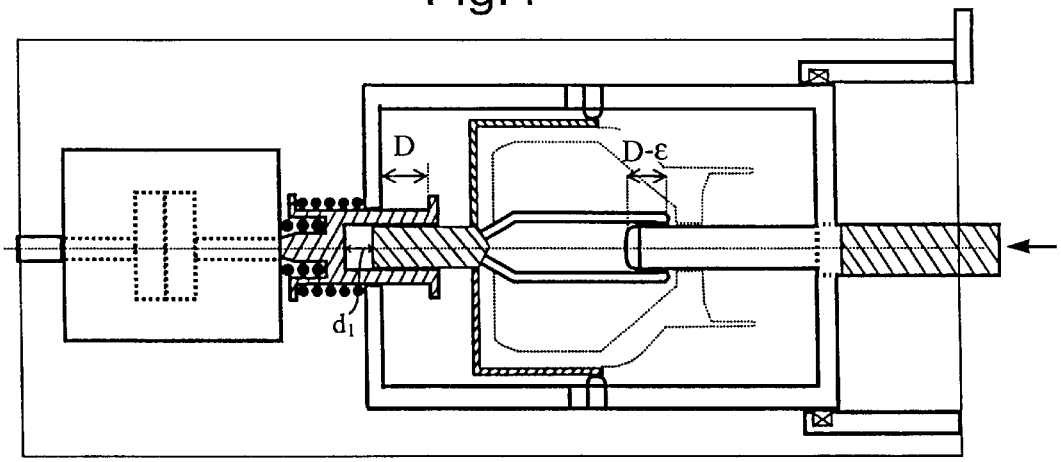
FIG. 4 is a diagram showing the principle of a hybrid interrupter device of the invention that is identical to the device shown in FIG. 1 except that the gas interrupter contacts are organized so that their separation occurs a short time before the separation of the contacts of the vacuum interrupter.

FIG. 4 is a diagram showing the principle of a device identical to the device shown in FIG. 1, except that the contacts of the gas interrupter are organized so that their separation takes place slightly before the separation of the contacts in the vacuum interrupter. To obtain such early separation of the contacts of the gas interrupter, it is necessary merely for the overlap distance over which the contacts overlap to be a little shorter than the above-described dead stroke D, when the interrupter device is closed. Thus, the overlap distance, i.e. a speed-gathering distance for the rod 6, is equal to $D-\epsilon$, where the distance $\epsilon$ is a function of the lapse of time desired for the early separation.

Figure 5:
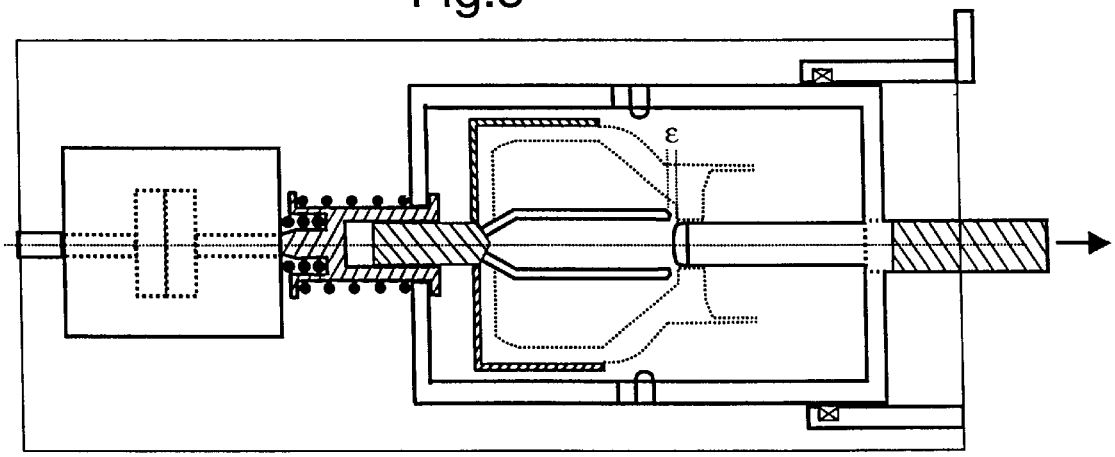
FIG. 5 shows an intermediate step of the opening of the hybrid interrupter device shown in FIG. 4.

In FIG. 5, at the instant when the rod 6 has traveled the dead stroke D, the contacts of the gas interrupter have just separated and they are spaced apart by the distance $\epsilon$. It can thus be seen that this distance $\epsilon$ can be defined as being the desired spacing for the contacts of the gas interrupter at the moment when the contacts of the vacuum interrupter are about to separate.

Figure 6:
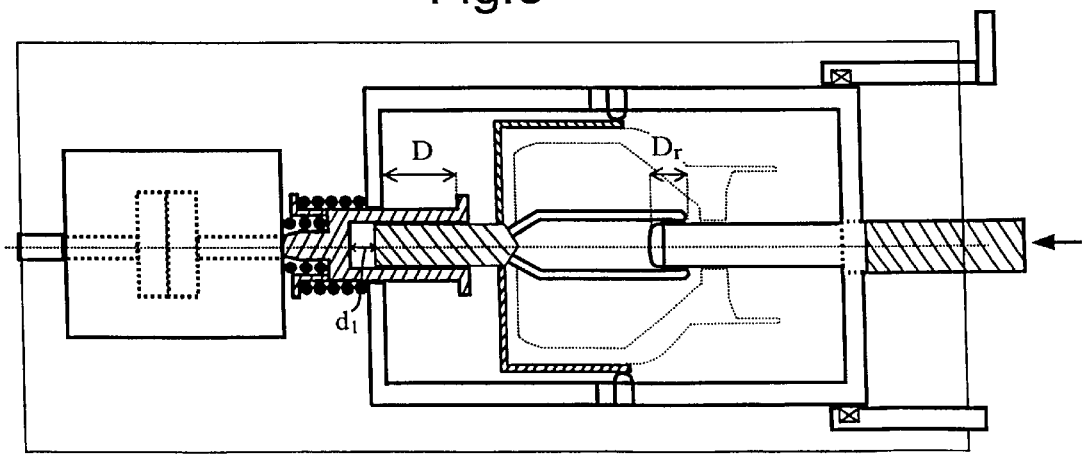
FIG. 6 shows a particular embodiment of a hybrid interrupter device of the invention, in which the separation of the contacts of the vacuum interrupter is organized so as to take place in delayed manner relative to the separation of the arcing contacts of the gas interrupter, with a view to using the device as a generator circuit-breaker in a medium voltage network.

In FIG. 6, another embodiment of a hybrid interrupter device of the invention is shown in an embodiment for which the device is intended to be used as a generator circuit-breaker in a medium-voltage network. The displacement means which are connected to connection means and to the drive rod of the device are, in this embodiment, organized so that the separation of the contacts of the vacuum interrupter is substantially delayed relative to the separation of the arcing contacts of the gas interrupter.

The overlap distance $D_r$ of the contacts of the gas interrupter is, in this embodiment, shorter than half the dead stroke D that can be traveled by the drive rod secured to the return-movement means. It should be observed that said overlap distance $D_r$ can also called the speed-gathering or acceleration distance, in particular in an equivalent embodiment where the contacts of the gas interrupter are disposed end to end. In general, for the applications of the device as a generator circuit-breaker, it is preferable to select a dead stroke that is longer than twice the speed-gathering distance of the moving contact of the gas interrupter.

This implies that an electric arc is formed between the contacts of the gas interrupter which are already separated by a certain distance before the dead stroke D has been traveled in full, i.e. before the contacts of the vacuum interrupter separate. The gas interrupter is therefore in time to cause the current to pass through zero before the vacuum interrupter interrupts the current, this being is an advantage when the device is used as a generator circuit-breaker.

It should be stressed that a device of this type must be capable of interrupting short-circuit currents with high unbalanced loads which delay the passage of current through zero. A hybrid interrupter device which presents a contact separating sequence, such as that of the device in FIG. 6, enables the current unbalance to be reduced and enables the current to pass through zero earlier, at a moment that is compatible with the operation of the vacuum interrupter.

Figure 7:
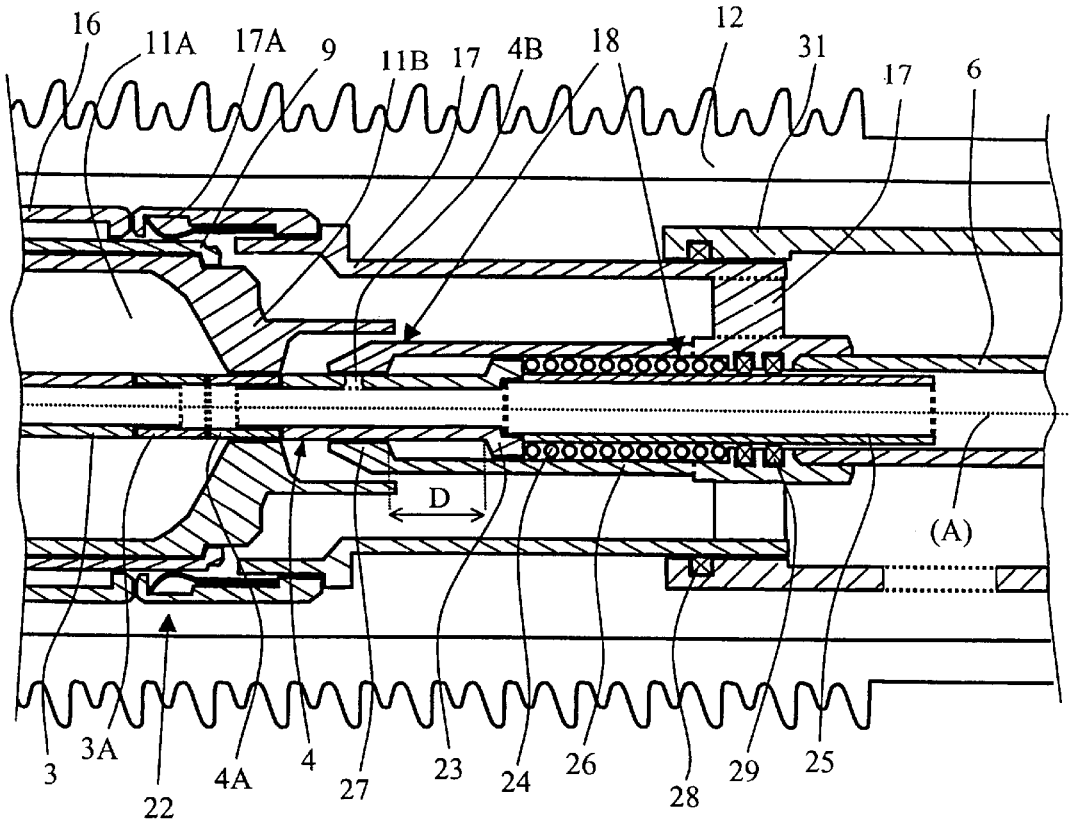
FIG. 7 is an enlargement of a portion of the hybrid interrupter device shown in FIG. 9 and diagrammatically shows a particular end-to-end disposition of the arcing contacts of the gas interrupter in a hybrid interrupter device of the invention.
Figure 9:
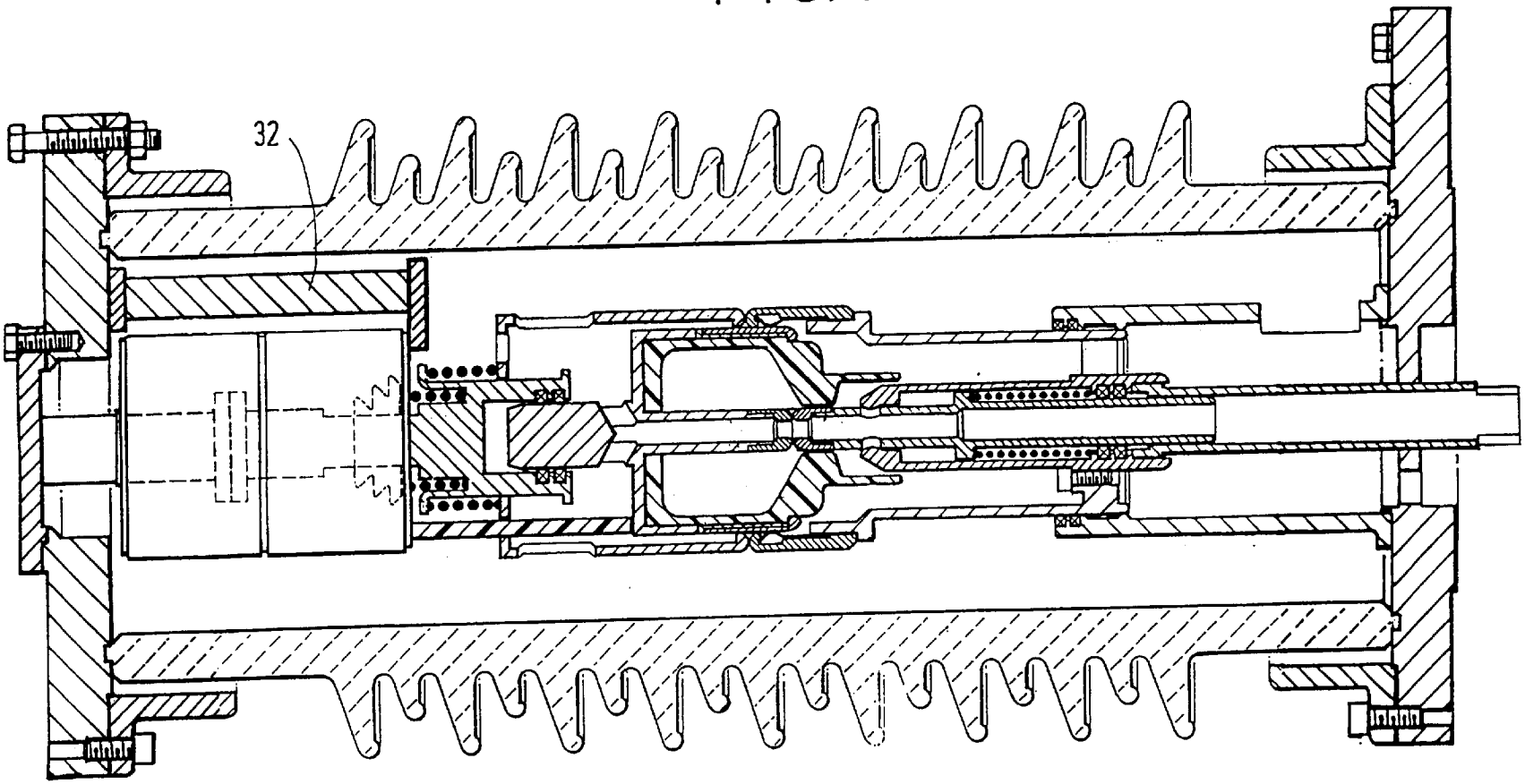
FIG. 9 is a diagrammatic view of a particular embodiment of the hybrid interrupter device of the invention in which the contacts of the gas interrupter are disposed end-to-end.

FIG. 7 is an enlarged fragmentary view of the hybrid interrupter device shown in FIG. 9, in the closed position. This view shows a particular end-to-end disposition of the arcing contacts of the gas interrupter in a hybrid interrupter device of the invention, in which the contacts 3 and 4 of the gas interrupter 11 are maintained in abutment one against the other, with a certain contact pressure being provided by resilient means.

Delay means 18 for delaying the start of movement of the moving contact 4 are interposed between said contact and the drive rod 6 for actuating the device, so that the contact 4 starting to move causes the contacts 3 and 4 to separate precisely at the instant when the rod 6 has traveled the above-defined speed-gathering distance.

The rod 6 and the contacts 3 and 4 are preferably tubular shaped along the axis A, and the end of each of the contacts 3 and 4 is advantageously provided with an respective end-piece 3A, 4A made of a refractory conductive material. The arcing contact 4 is also provided with orifices or openings 4B for discharging hot gases under excessive pressure inside the tubular structure of said contact while a fault current is being interrupted by the arcing contacts 3 and 4. The gases under excessive pressure are discharged into the space lying between the rod 6 and the conductive tube 31 via openings provided for this purpose in the second portion 17. Finally, the gases are subjected to final expansion by going into the volume adjacent to the inside wall of the casing 12 via openings provided for this purpose in the conductive tube 31. Naturally, other configurations for openings for discharging the gases under excessive pressure may be provided.

The delay means 18 comprise:

a first tubular element 25 disposed in axial alignment with the contact 4, secured thereto, and mounted to slide inside the rod 6 while said rod is moving, the speed-gathering distance for the rod 6 being defined by the stroke allowed for this sliding;

third abutment means 23 fixed to one end of the tubular element 25 where it is connected to the contact 4;

a second tubular element 26 secured via one end to the second portion 17 of the return means 15, and of diameter larger than the diameter of the tubular element 25, which second tubular element can slide along the third abutment means 23 along the axis A while the rod 6 is moving, and has its other end provided with an annular cap 27 serving to come into abutment against the abutment means 23; and a third helical spring 24 disposed along the axis A, interposed between the first and second tubular elements, and in abutment at one end against the third abutment means 23, and at the other end against the second portion 17 of the return means 15.

In the embodiment shown, the delay means 18 are dimensioned so that the speed-gathering distance is equal to the dead stroke D that can be traveled by the return means 15 relative to the connection means 13, so as to obtain simultaneous separation of both pairs of contacts.

When the current is being interrupted by the device, once the sliding contact 17A is disconnected from the conduction element 9, and before the instant at which the contacts 3 and 4 separate, the fault current flows from the fixed contact 3 to the conductive tube 31 via the contact 4, the tubular element 25, the sliding contacts 29, a segment of the second portion 17 of the return means 15, and finally the sliding contacts 28.

While the portions 16 and 17 of the return means 15 are moving in translation together, the moving contact 4 is held in abutment against the fixed contact 3 with a certain contact pressure by means of the thrust exerted by the third spring 24. Once the speed-gathering distance has been traveled by the rod 6, the annular cap 27 comes into abutment against the abutment means 23. The spring 24 no longer exerts any action on the contact 4 which is then driven in translation with the rod 6 and with the second portion 17. Thus, the moving contact 4 is constrained to move in translation with the parts 6 and 17 only as from a precise instant.

Similarly to the device shown in FIG. 1, the operation of the device in this embodiment is organized to obtain the separation of the contacts 3 and 4 in the gas interrupter simultaneously with separation of the contacts 1 and 2 in the vacuum interrupter. However, it is possible to provide early separation of the contacts of the gas interrupter by organizing the elements of the device so that the speed-gathering distance is shorter than the distance D, in a manner analogous to the configuration shown in FIG. 5.

Figure 8:
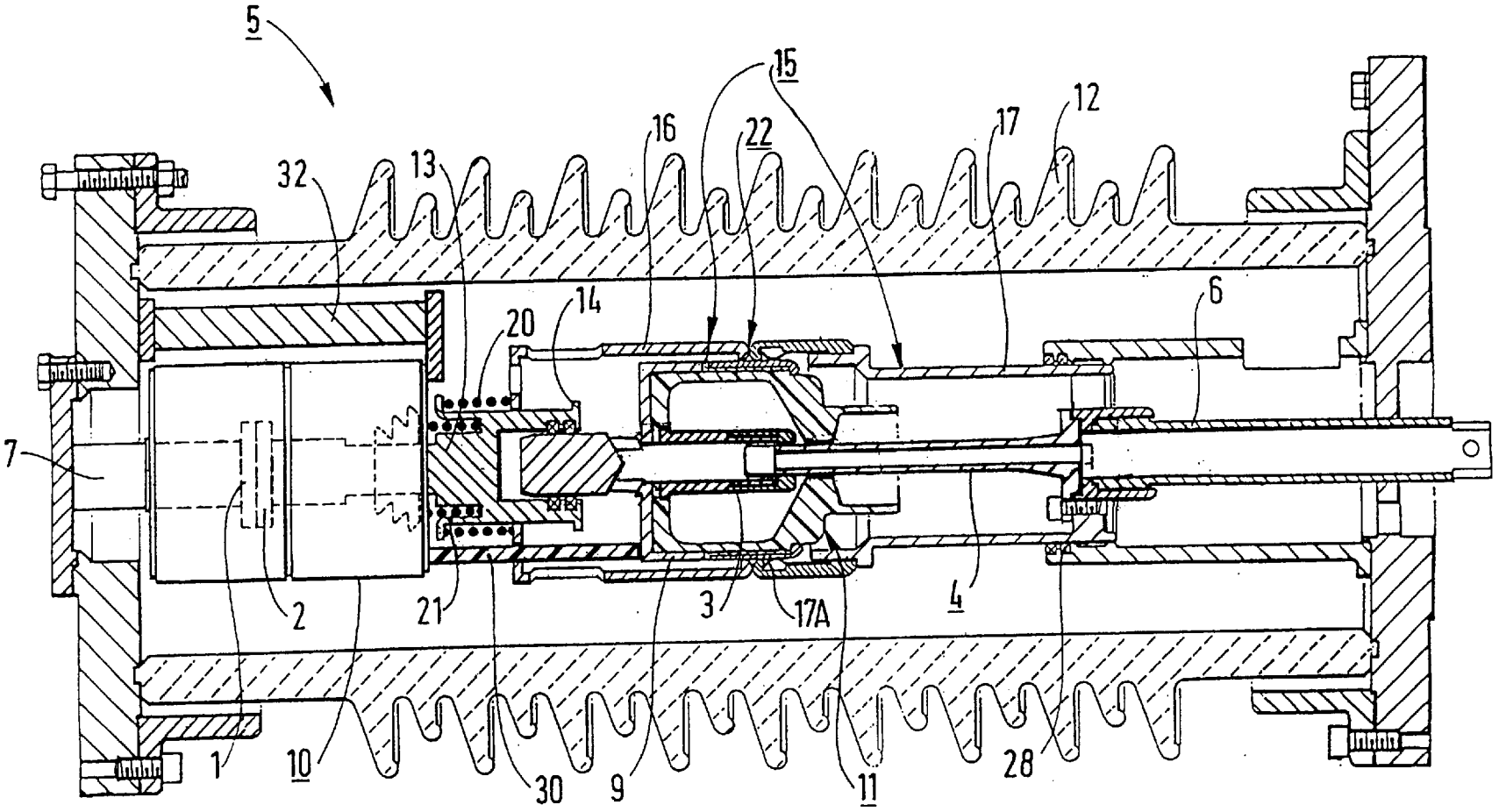
FIG. 8 is a diagrammatic view of an embodiment of the hybrid interrupter device whose principle is shown in the simplified diagram of FIG. 1.

FIG. 8 diagramatically shows an embodiment of a hybrid device, the principle of which is shown in the simplified diagram of FIG. 1. The contacts of the gas interrupter are mutually interfitted with a certain overlap distance when the interrupter device is closed, as in FIG. 1.

The volume adjacent to the inside wall of the casing common to both of the interrupters is dimensioned to receive a varistor 32 that is electrically connected in parallel with the contacts of the vacuum interrupter so as to be capable of limiting the voltage applied to said interrupter. This makes it possible to distribute appropriately the voltage applied respectively to the vacuum interrupter and to the gas interrupter during opening of the interrupter device. The distribution of the voltage may also be adjusted by means of at least one capacitor mounted in parallel with the interrupter device or in parallel with one of the two interrupters.

In air-insulated switchgear as shown, in which the interrupter devices in series can be received in a vertical insulating casing, it may be advantageous to dispose the vacuum interrupter in the portion of the casing that is furthest away from the ground. This makes it possible to obtain a natural voltage distribution that gives a voltage across the gas interrupter device that is higher than the voltage applied to the vacuum interrupter. In addition, the relative compactness of a device of the invention can make it possible to use an existing insulating casing designed for a non-hybrid gas interrupter.

The electrical link between the varistor 32 and the moving contact of the vacuum interrupter is provided by means of the metal sealing bellows of the interrupter. The electrical link between the connection means 13 and the conductive stud forming the second abutment means 19 is provided by sliding contacts. Orifices or openings are provided at the connection between the stud and the conduction element 9 that surrounds the blast chamber of the gas interrupter, so as to enable the hot gases to be discharged as explained in the description of FIG. 7. Such openings are also provided in the first and second portions 16 and 17 of the return means 15, and in the conductive tube in which said second portion can slide.

Electrically-insulating ties 30 participate in mechanically holding the gas interrupter in the casing of the interrupter device. These ties are fixed via one end to that face of the vacuum interrupter through which the rod carrying the moving contact passes. They are rigidly secured via their other ends to the conduction element 9, and they thus make it possible to keep the third contact and the blast nozzle of the thermal blast volume fixed in the gas interrupter.

The drive rod 6 of the device is rigidly secured to the moving contact 4 and to the second portion 17 of the return means 15. The three elements 6, 4, and 17 are thus constrained permanently to move in translation with one another in this embodiment.

FIG. 9 diagrammatically shows, in the closed position, another embodiment of a hybrid interrupter device of the invention. In this embodiment, the contacts of the gas interrupter are disposed end-to-end. Numerous elements are identical to those used in the embodiment shown in FIG. 8. However, because of the different structure of the contacts of the gas interrupter, the moving contact of said interrupter cannot be driven as directly as in the embodiment in which said contacts are interfitted. In order to comply with the desired sequence of opening of the interrupters, delay means 18 as described in detail with reference to FIG. 7 are provided to delay the start of movement of said moving contact. Said means make it possible for the rod 6 to travel over the speed-gathering distance as explained above, and they thus enable the moving contact to be driven by the rod 6 at a high speed at the beginning of separation of the contacts of the vacuum interrupter, as in the embodiment having interfitted contacts.

Figure 10:
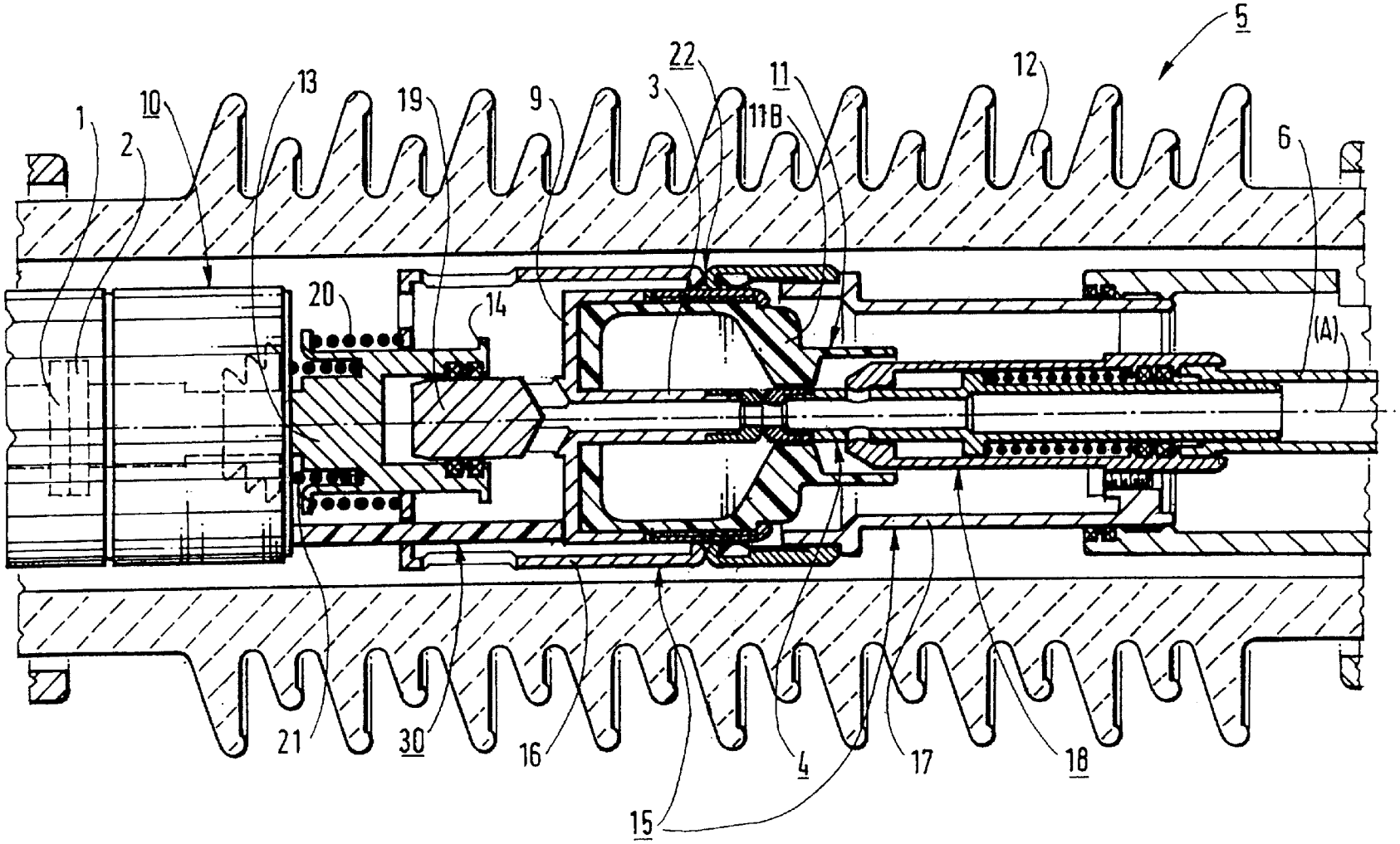
FIG. 10 is a fragmentary view of the hybrid interrupter device shown in FIG. 9 and from which the varistor has been removed.

In FIG. 10, the elements of the hybrid interrupter device shown are identical to those in FIG. 9, except for the varistor, which has been removed, and for the insulating casing, whose diameter has been reduced accordingly.

Figure 11:
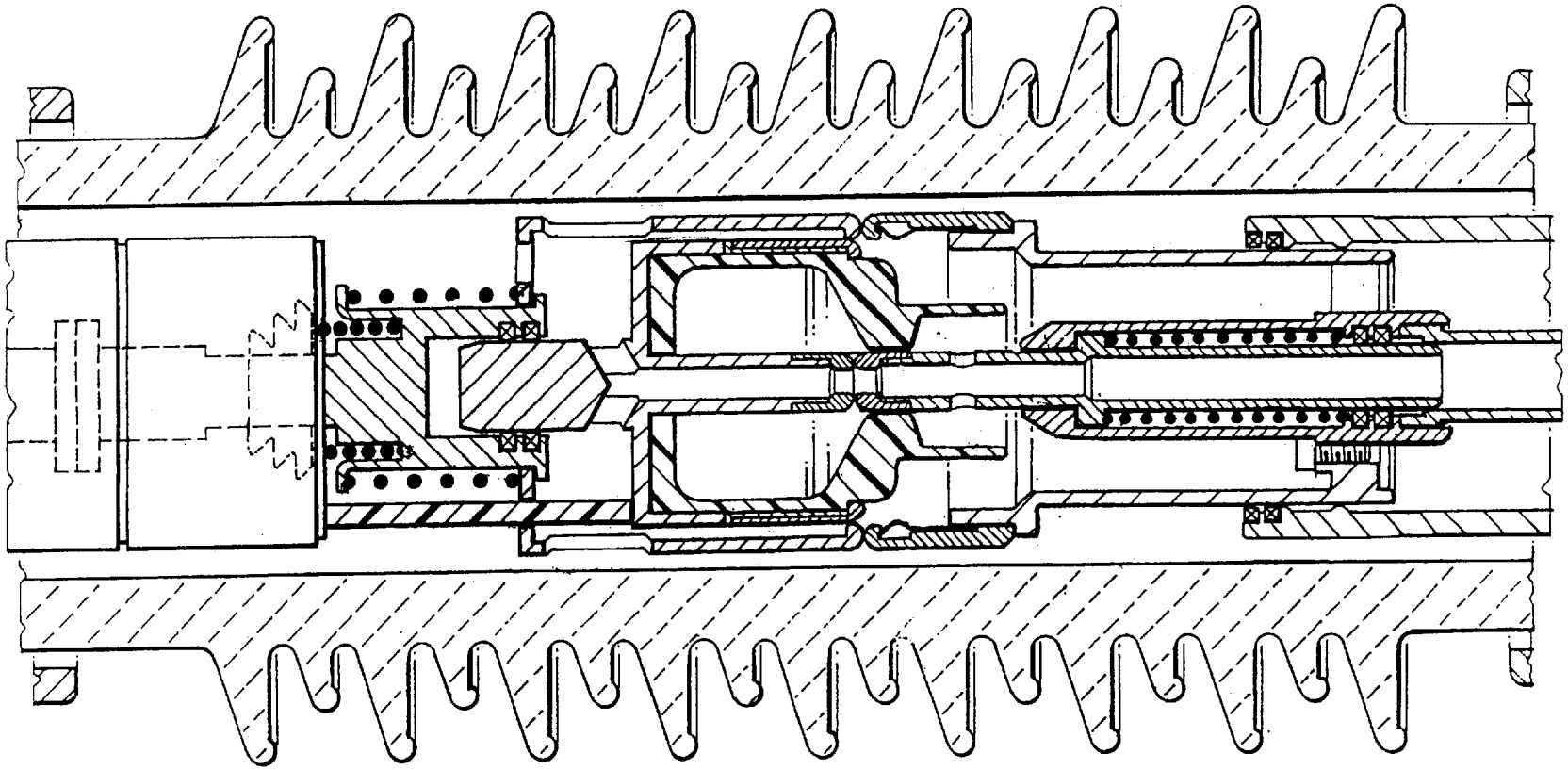
FIGS. 11 to 13 show successive steps in the opening of the hybrid interrupter device shown in FIG. 10.

FIG. 11 shows the device of FIG. 10 at an instant corresponding to the stage shown in FIG. 2 while the device is opening to interrupt current.

Figure 12:
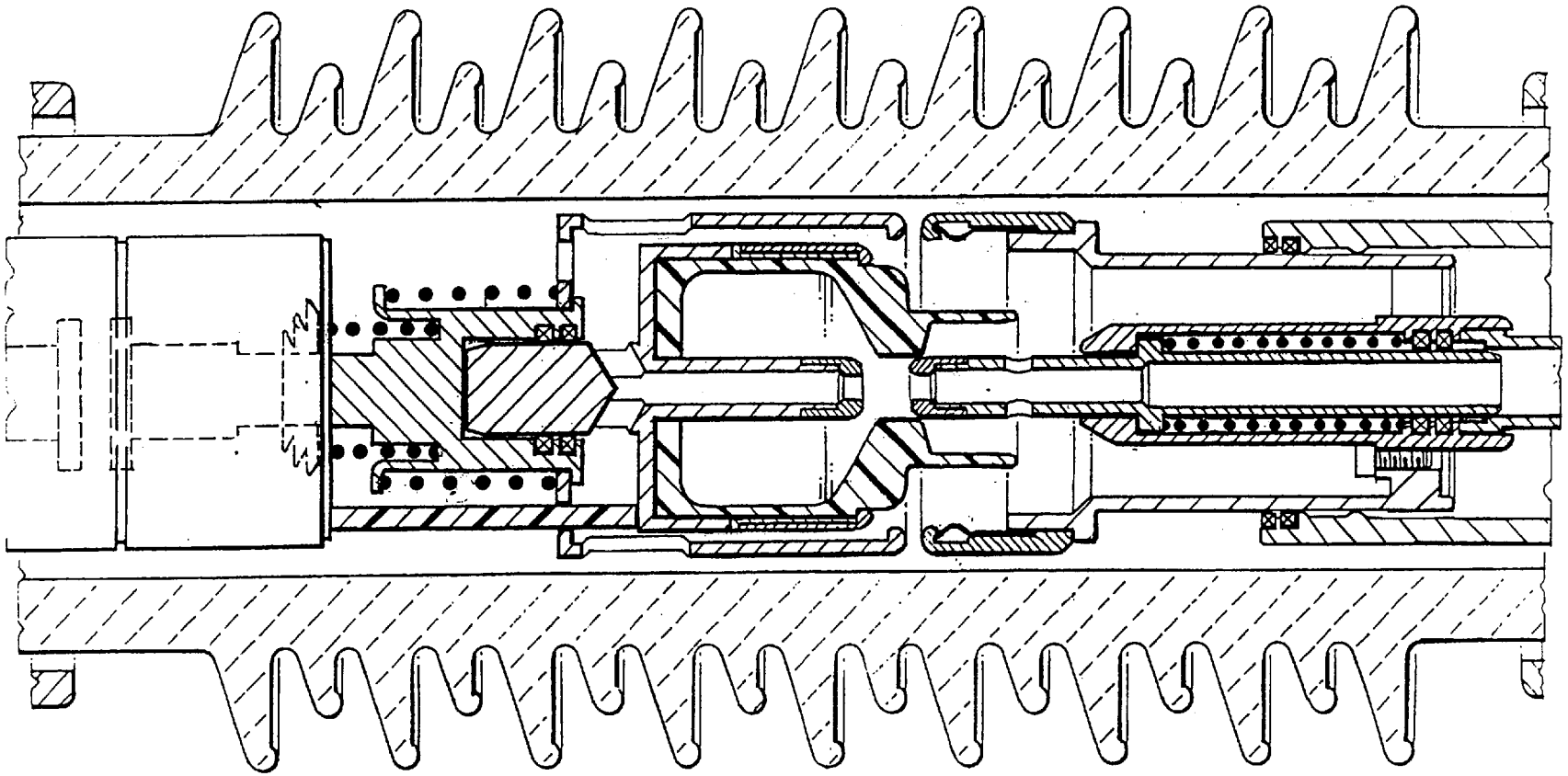
Figure 13:
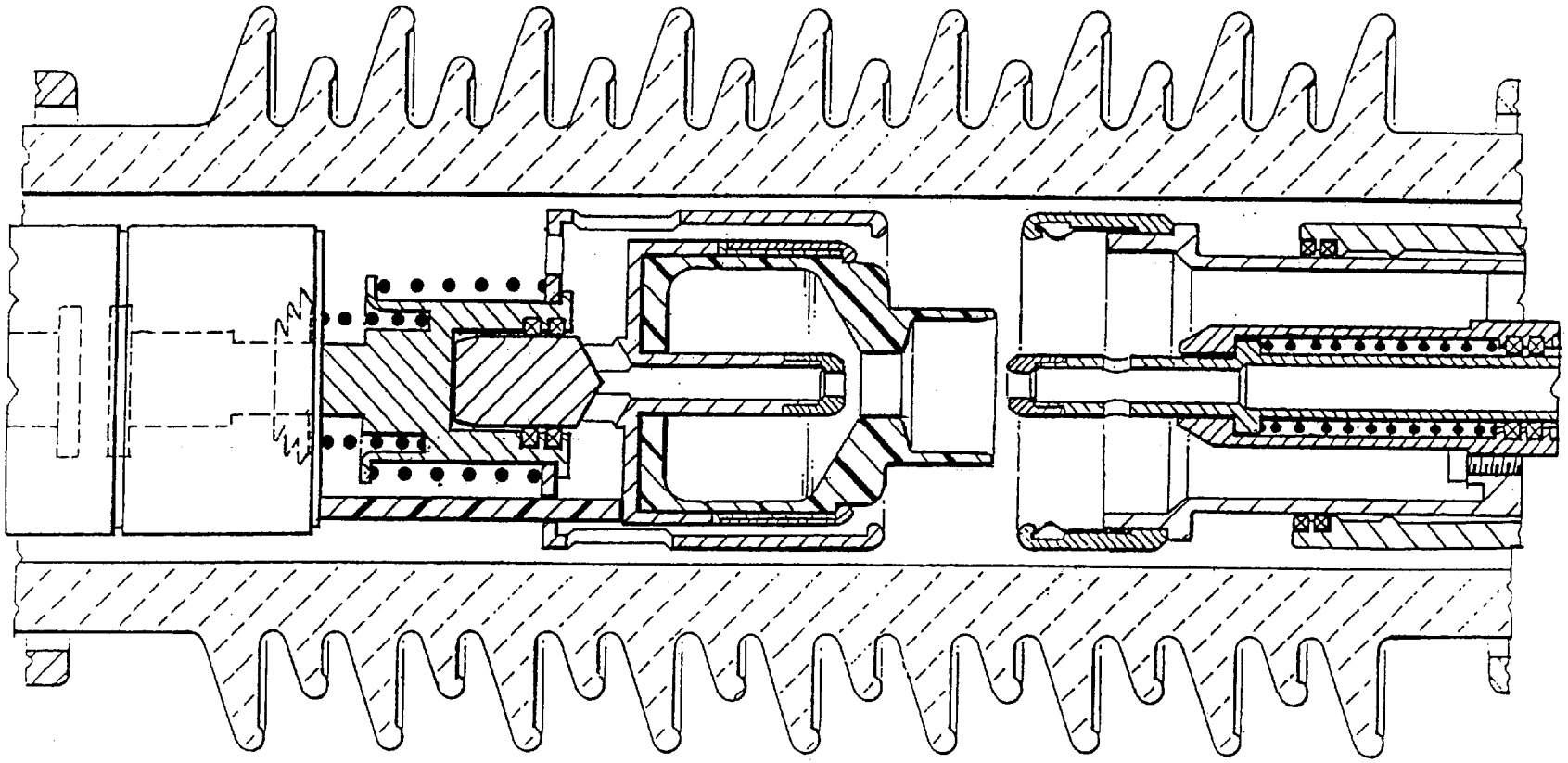

FIGS. 12 and 13 show the device of FIG. 10 at instants corresponding respectively to the stage of FIG. 3 and to the end of the device being opened when the contacts of the vacuum interrupter are completely separated.

Figure 14:
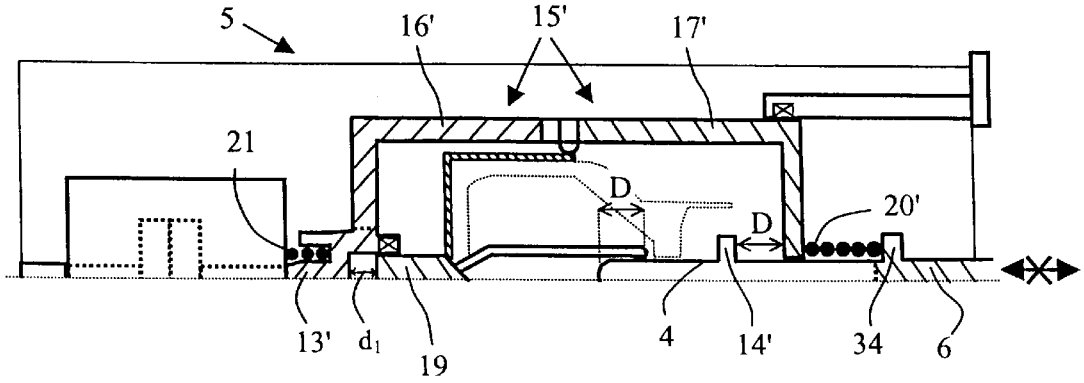
FIG. 14 is a diagram showing the principle of another embodiment of a hybrid interrupter device of the invention.

In FIG. 14, a diagram showing the principle of another embodiment of a device of the invention is shown in longitudinal half-section. This embodiment differs from the embodiment shown in FIG. 1 in that the dead-stroke link means connecting the connection means 13 to the rod 6 are organized differently. These link means comprise return means 15' which co-operate with first resilient means comprising a first spring 20' ensuring the same function as the first spring 20 shown in FIG. 1. The return means 15' are connected directly to the connection means 13, and the spring 20 is disposed between said means 15' and the rod 6.

As in the other embodiments, the spring 20' exerts a thrust on the connection means 13' to keep the contacts of the vacuum interrupter closed. In this example, this thrust is exerted via the return means 15', until the rod 6 has traveled the dead stroke D under the action of the spring 20' relaxing, which spring bears against an annular shoulder 34 that is integral with the rod. The first resilient means further comprise first abutment means 14' which, in this example, are secured to the mobile contact 4 of the gas interrupter. These abutment means 14' co-operate with the first spring 20' to limit at the distance D the stroke over which the rod 6 travels relative to the return means 15'.

The return means 15' comprise two portions 16' and 17' that can be moved together by abutting against one another, and that can be dissociated while the vacuum interrupter is opening. The first portion 16' is permanently constrained to move in translation with the connection means 13. The second portion 17' is not constrained to move in translation with the rod 6 so long as said rod is traveling over the dead stroke D relative to the return means 15', and it becomes constrained to move with said rod once said stroke has been traveled. As a result of the increase in the mass of elements constrained to move with the rod 6 after the contacts of the gas interrupter have separated, this embodiment can suffer from the drawback of increasing the actuating energy to be delivered to the rod in order to gather sufficient speed for the contact 4 for interrupting "capacitive" currents.

In analogous manner to the device shown in FIG. 1, the displacement means connected to the connection means 13' comprise second resilient means which comprise a second spring 21 co-operating with said abutment means 19.

A hybrid interrupter device of the invention makes it possible for the thermal stage of current interruption, i.e. the period of a few microseconds during which the voltage begins to recover, to be performed to a large extent by the vacuum interrupter of the device. The gas interrupter contributes essentially to withstanding the peak value of the voltage, by means of the relatively long contact separation distance inherent in this type of switchgear compared with a vacuum interrupter. In particular, this offers the possibility of using a gas other than $SF_6$ for blasting in the gas interrupter. $SF_6$ is generally chosen for its properties of withstanding high voltage recovery speeds during the thermal stage of the interruption. Since withstanding the transient recovery voltage during the thermal stage is provided by the vacuum interrupter in a hybrid device of the invention, some other gas or gas mixture having sufficient dielectric properties can then be used in the gas interrupter of the device. Nitrogen under high pressure has the required dielectric properties for high voltage. Since it does not have any risks for the environment, it constitutes a preferred solution for use with a gas other than $SF_6$. Alternatively, a mixture made up of over 80% nitrogen and of another gas such as $SF_6$ offers at least the advantage of considerably reducing the risks for the environment compared with using $SF_6$ pure.

What is claimed is:

1. A hybrid interrupter device for high or medium voltage, the device comprising:

a casing filled with a dielectric gas and having a longitudinal axis;

a vacuum interrupter disposed inside the casing, and having a first pair of arcing contacts constituted by a first contact which is fixed and by a second contact which can be moved in translation in the longitudinal axial direction of the casing;

means provided to exert a force on said second contact such that the mutual pressure between the contacting surfaces of said first and second contacts is greater than a determined value while said vacuum interrupter is allowing current to pass;

a gas interrupter disposed inside the casing, and having a second pair of arcing contacts constituted by a third contact which is fixed and by a fourth contact which can be moved in translation in the longitudinal axial direction, and also having a blast chamber which comprises a thermal blast volume; and a drive rod connected to the fourth contact and that can be held stationary or moved in translation by control means;

the device further comprising:

connection means electrically interconnecting the second and third contacts, and capable of being moved in translation in the longitudinal axial direction together with the second contact;

displacement means connected to said connection means and to said drive rod for displacing them so as to separate the second and fourth contacts from the first and third contacts respectively, said displacement means comprising dead-stroke link means connecting said connection means to said rod, the link means making it possible to displace said rod over a determined dead stroke while also acting on said connection means to keep the vacuum interrupter closed during this displacement.

2. The hybrid interrupter device according to claim 1, intended to be used as a circuit-breaker in a high-voltage network, in which said displacement means are organized so that the separations of the contacts both of the vacuum interrupter and of the gas interrupter take place simultaneously or with a small offset in time.

3. The hybrid interrupter device according to claim 2, in which said dead-stroke link means comprise return-movement means which co-operate with first resilient means connected to said connection means or to said rod.

4. The hybrid interrupter device according to claim 3, in which said displacement means comprise second resilient means suitable for co-operating with the connection means for separating the contacts of the vacuum interrupter as soon as the drive rod has traveled over said dead stroke, and suitable for displacing said connection means and the second contact over a determined isolation stroke relative to the first contact while the device interrupts current, said isolation stroke corresponding to the complete separation distance of the contacts of the vacuum interrupter.

5. The hybrid interrupter device according to claim 4, in which said first and second resilient means respectively comprise a first spring and a second spring each compressed and suitable for extending with a determined extension, said springs co-operating respectively with first abutment means and second abutment means each suitable for interrupting the relaxation of the spring with which it co-operates, each spring exerting thrust on said connection means along the axis, the two springs exerting thrust in opposite directions.

6. The hybrid interrupter device according to claim 5, in which said first abutment means are secured to said connection means.

7. The hybrid interrupter device according to claim 5, in which said second abutment means are electrically and mechanically connected to the third contact, and provide the electrical connection with said connection means.

8. The hybrid interrupter device according to claim 3, in which said return-movement means comprise two portions suitable for being displaced together in mutual abutment, and suitable for being dissociated during opening of the vacuum interrupter.

9. The hybrid interrupter device according to claim 7, in which a first portion of said return-movement means is subjected to a thrust from the first resilient means which makes it possible to displace said first portion over said dead stroke relative to the connection means, and in which a second portion is constrained to move in translation with the drive rod of the device.

10. The hybrid interrupter device according to claim 1, in which the arcing contacts of the gas interrupter are interfitted one in the other when in the closed position, with an overlap distance that is less than or equal to said dead stroke D.

11. The hybrid interrupter device according to claim 1, in which the contacts of the gas interrupter are in mutual abutment in the closed position, and in which delay means for delaying the start of movement of the fourth contact are interposed between said contact and said rod.

12. The interrupter device according to claim 11, in which said rod and the third and fourth contacts are tubular in shape along the axis, and in which said delay means comprise:

a first tubular element that is disposed in axial alignment with the fourth contact, that is secured thereto, and that can slide inside the rod while said rod is being displaced, the sliding distance being less than or equal to said dead stroke;

third abutment means fixed to an end of the first tubular element where it is connected to the fourth contact;

a second tubular element that is secured via one end to the second portion of the return means, that is of a diameter greater than the diameter of the first tubular element, that can slide along the third abutment means along the axis while the rod is being displaced, and that is provided at its other end with an annular cap serving to come into abutment with said abutment means; and a helical third spring disposed along the axis, interposed between the first tubular element and the second tubular element, in abutment at one end against the third abutment means and at the other end against the second portion of the return means.

13. The hybrid interrupter device according to claim 5, in which the connection means are constituted by a metal socket that is circularly symmetrical about the axis, said socket having:

a tubular portion which, at its open end, has a first annular shoulder that constitutes the first abutment means; and a cylindrical portion in which an annular recess is provided that is open facing towards the vacuum interrupter and that serves to receive the second spring, and in which the wall that surrounds said annular recess has, at its end, a second annular shoulder for holding the first spring in abutment.

14. The hybrid interrupter device according to claim 13, in which the first portion of the return means has, at one end, an annular wall which comes into abutment against an end of the first spring, and in which the inside diameter of said annular wall is equal to the outside diameter of the tubular portion of said socket.

15. The hybrid interrupter device according to claim 13, in which the second abutment means are constituted by a cylindrical stud fixed to the third contact and disposed in axial alignment therewith, said metal socket being engaged over said stud and being mounted to slide therein while also providing permanent electrical contact therewith, the tubular portion of said socket having an end-wall serving to come into abutment against said stud.

16. The hybrid interrupter device according to claim 5, in which the magnitudes of the thrusts of the first and second springs are organized to have, at all times, a difference in favor of the magnitude of the first spring, this difference remaining continuously greater than a determined threshold.

17. The hybrid interrupter device according to claim 8, in which the second of the two portions of the return means is electrically connected permanently to a terminal and supports a sliding contact serving to be in electrical contact with a conduction element when the interrupter device is closed, said conduction means being mechanically and electrically connected permanently to the connection means.

18. The hybrid interrupter device according to claim 17, in which said conduction element is rigidly connected to the vacuum interrupter via electrically insulating ties.

19. The hybrid interrupter device according to claim 1, in which a varistor is electrically connected in parallel with the contacts of the vacuum interrupter in order to make it possible to limit the voltage applied to said vacuum interrupter.

20. The hybrid interrupter device according to claim 1, in which a capacitor is mounted in parallel with one of the interrupters or in parallel with each of the interrupters.

21. The hybrid interrupter device according to claim 1, intended to be used as a generator circuit-breaker for a medium-voltage network, in which device said displacement means are organized so that the separation of the contacts of the vacuum interrupter is substantially delayed relative to the separation of the arcing contacts of the gas interrupter, in order for the gas interrupter to cause the current to pass through zero before the vacuum interrupter interrupts the current.

22. The hybrid interrupter device according to claim 21, in which the first abutment means of the dead-stroke link means are organized so that said dead stroke is longer than twice the speed-gathering distance of the moving contact of the gas interrupter.

* * * * *